US008601971B2

(12) United States Patent
Kent

(10) Patent No.: US 8,601,971 B2
(45) Date of Patent: Dec. 10, 2013

(54) SUSPENDED BOAT COVER AND SUSPENDED BOAT COVER SYSTEM

(75) Inventor: Randy Kent, Lee's Summit, MO (US)

(73) Assignee: Marine Concepts, LLC, Osage Beach, MO (US)

( * ) Notice: Subject to any disclaimer, the term of this patent is extended or adjusted under 35 U.S.C. 154(b) by 428 days.

(21) Appl. No.: 12/426,241

(22) Filed: Apr. 18, 2009

(65) Prior Publication Data

US 2009/0293797 A1 Dec. 3, 2009

Related U.S. Application Data

(60) Provisional application No. 61/046,159, filed on Apr. 18, 2008.

(51) Int. Cl.
*B63B 17/02* (2006.01)
*E04H 15/04* (2006.01)

(52) U.S. Cl.
USPC ..... 114/361; 135/90

(58) Field of Classification Search
USPC ..... 114/361; 135/88.01, 90, 96, 156, 152, 135/153; 248/276.1, 282.1, 284.1, 323, 248/324, 341
See application file for complete search history.

(56) References Cited

U.S. PATENT DOCUMENTS

| | | | | |
|---|---|---|---|---|
| 2,732,877 A | | 1/1956 | Taylor | |
| 3,698,409 A | * | 10/1972 | Koontz et al. | 114/361 |
| 4,019,212 A | | 4/1977 | Downer | |
| 4,247,509 A | * | 1/1981 | Talbot | 264/230 |
| 4,363,284 A | | 12/1982 | Monroe | |
| 5,086,799 A | | 2/1992 | Lumbleau | |
| D368,063 S | | 3/1996 | Newton | |
| 5,564,358 A | * | 10/1996 | Newton | 114/361 |
| 5,709,501 A | | 1/1998 | Elbers | |
| 5,769,105 A | | 6/1998 | Margol et al. | |
| 6,167,658 B1 | * | 1/2001 | Weiner | 52/2.11 |
| 6,659,035 B2 | * | 12/2003 | Treytiak | 114/361 |
| 6,895,886 B1 | * | 5/2005 | Pawlowski et al. | 114/361 |
| 7,194,976 B1 | * | 3/2007 | Kramer | 114/361 |
| 2007/0095271 A1 | | 5/2007 | Yang | |

* cited by examiner

*Primary Examiner* — Lars A Olson
*Assistant Examiner* — Anthony Wiest
(74) *Attorney, Agent, or Firm* — Boyle Fredrickson, S.C.

(57) ABSTRACT

A boat cover for a suspended cover system that is configured to fit a boat in a manner that prevents relative movement therebetween minimizing wear. The cover has at least one fitting seam that follows part of the top of the boat. An integral cover cinching arrangement enables tightening the bottom of the cover against the hull hugging it. Vents overlying a passenger section minimize wind force by reducing cover pressure differential. The cover can be equipped with a second fitting seam that extends along the gunwale of the boat and can have a downwardly extending fitting seam section that extends below the gunwale toward the bow to help fit the cover to the front portion of the hull of the boat. Stretchable straps used to hang the cover from a track of the boat cover system can be used to minimize force on the cover caused by wave action.

28 Claims, 12 Drawing Sheets

SUSPENDED BOAT COVER AND SUSPENDED BOAT COVER SYSTEM

CROSS REFERENCE

This application claims the benefit under 35 U.S.C. §119 (e) of U.S. Provisional Application Ser. No. 61/046,159, filed Apr. 18, 2008, the entirety of which is expressly incorporated by reference herein.

FIELD

The present invention relates to an improved boat cover and more particularly to a suspended boat cover carried by a support frame or the like that is better able to resist wind and wave action.

BACKGROUND

Conventional boat covers, including those that are custom made, must be manually taken completely off, placed on the dock or ground nearby, and thereafter put back each time a boat is used, which is extremely time consuming and tedious. In addition, placing the cover on the dock or ground while the boat is being used can result in the cover collecting dirt and other debris, which can be deposited on and into the boat when the cover is put back on after use.

In the past, others have tried to make covering and uncovering a boat faster and more convenient by mounting the cover to overhead structure typically used to support a roof of a dock. An example of such a boat cover is disclosed in U.S. Pat. No. 5,769,105. In other known boat cover arrangements, the cover is vertically movable by a user from a position where it covers the boat to another position where the boat is uncovered enabling it to be used. Examples of such boat covers are disclosed in U.S. Pat. Nos. 4,019,212; 5,086,799 and 5,709,501.

One known boat cover arrangement disclosed in U.S. Pat. No. 7,194,976 employs a boat cover that is horizontally movable along a track attached to beams that support a roof of a dock between a covered position where the cover overlies a boat in the water underlying the roof and an uncovered position where the cover is moved away from the boat uncovering the boat enabling the boat to be used. There is a zipper assembly that enables the rear edges of the panels that make up the cover to be joined together along the back of the boat. While this boat cover arrangement has enjoyed considerable commercial success, improvements nonetheless remain desirable.

For example, when in the covered position, the boat cover loosely hangs downwardly over the boat enabling bugs, pollen and other matter to get between the boat hull and the cover. Relative movement between the boat and cover due to wave and wind action can mash and grind this material such that it coats the hull, defeating the very purpose the cover is supposed to fulfill. In addition to requiring more frequent cleaning of the outer surface of the boat hull in areas typically covered by the cover, this relative movement can accelerate wear and tear on the cover, necessitating more frequent and costly replacement.

As a result, improvements to this boat cover arrangement are desired that overcomes these disadvantages. In addition, it is desired to provide a cover that is more versatile and convenient to use.

SUMMARY

The present invention is directed to a boat cover for a suspended boat cover system for covering a boat in a slip of a dock. The cover is configured to be form fitting and to accommodate movement in a manner that minimizes relative movement between the cover and boat to which it is attached thereby preventing wear and tear on both. In addition, an arrangement for tightening the bottom of the cover against the hull not only helps prevent relative motion between the cover and boat but it also helps keep insects and other debris from getting in between the cover and the boat. The cover can also be configured with an integral solar powered trickle charging marine battery charging arrangement.

The cover is made of a pair of cover panels of a durable, weather resistant fabric or other material. The panels can be formed of a single panel having a fold line disposed at the front of the boat or a pair of segments joined together by a seam or the like. Fitting seams help conform the cover to the shape of the boat making it more difficult for relative movement to occur between the cover and boat. A cinching arrangement is employed to constrict or urge a bottom portion of the cover against the hull about the periphery of the hull thereby helping to ensure the cover and boat move as one while keeping insects and other debris out. Elastic or elastomeric hanger straps can be used to hang the cover from a track of the suspended cover system, where a track is employed.

The cover can have shirring or the like that tends to pull the cover against the hull of the boat, at least along the front or bow section of the boat. Such shirring can be of elastic or elastomeric construction and be sewn onto or along the boat cover, including along an interior surface thereof. The cinching arrangement can be used in addition to or in lieu of such shirring. The cinching arrangement includes a line, such as a rope, that is slidably received in a sleeve of the cover that extends about a bottom portion of the cover. The cinching arrangement includes a ratchet that engages the line to releasably tighten the line, and hence the bottom of the cover, against the hull about the bottom periphery of the cover. Because the cover panels are joined together along their rear edges at the stern of the boat by a releasable fastener arrangement, a clip or buckle is provided that releasably joins one section of the cinching line to another section of the cinching line.

At least one fitting seam joins the cover panels together and follows a contour along a top surface of the boat, such as the foredeck section, windshield and cabin, where so equipped. Such a fitting seam extends downwardly from a reinforced section that extends the length of the panels along the top of the cover. The fitting seam extends downwardly at an angle to track or follow the contour of at least a portion of the top of the boat along a portion of the front of the boat. Together, with the cinching arrangement, a fit is achieved that tightly or snugly fits the boat being covered thereby minimizing and substantially preventing relative movement between the cover and the boat.

In a preferred embodiment, the cover includes a fitting seam that extends along a gunwale of the boat and which does not join one cover panel to the other cover panel. The fitting seam extends along the stern and passenger or cabin section of the boat and has a downwardly angled section that extends downwardly toward the bow of the boat. The downwardly angled section includes a pair of divergent seams that each extend from a fore section of the boat that is downstream of the bow but adjacent the windshield or cabin of the boat. Each divergent fitting seam of one cover panel converges toward and meets or connects to the corresponding divergent fitting seam of the other cover panel. The divergent or angled fitting seams help form fit the cover for the shape of bow of the particular boat to which the cover is designed to attach. This too helps prevent relative movement between the cover and boat.

Each cover panel also has at least one vent attached to it that enables venting the interior of the cover. This not only prevents mold and mildew but also advantageously reduces the pressure differential caused by wind blowing over the boat. Reducing pressure differential reduces the magnitude of the wind force acting on the cover, which also reduces relative movement between the cover and boat. Such a vent can be equipped with a plurality of louvers that help scoop or direct wind through a plurality of apertures arranged in a plurality of rows. A screen overlies the vent apertures along the interior of the cover to help prevent bugs and other debris from getting inside the cover. In a preferred embodiment, each cover panel has a plurality of vents spaced apart along a longitudinal direction relative to the boat and disposed over a cabin or passenger area where the cover tends to hang down and not be in direct contact with the boat.

The cover can be equipped with a generally triangular section above the foredeck and/or windshield that interconnects a main portion of the cover and a reinforced section that extends adjacent to and along the track. In one preferred embodiment, the generally triangular section is imperforate and serves to help deflect wind impinging against the boat and cover. In another preferred embodiment, the section that extends above the foredeck has a plurality of windows in it that allow wind to pass through thereby reducing the force of the wind tending to try to move the cover and/or boat. Such a perforate or windowed construction advantageously helps maximize stability by minimize the impact of the force of the wind exerted against that portion of the cover.

In use, the cover is grasped at its rear end and walked to extend it substantially along the full length of the boat. The rear edges of the cover can be fastened together using the releasable fastener arrangement. The buckle or clip is engaged to connect one cinching line to the other. A ratchet or other tightening arrangement of the cinching arrangement is manipulated to tighten the line around the bottom of the hull. Thereafter, wave action that causes the boat to drop relative to the track stretches the elastic or elastomeric hanger straps thereby minimizing the upwards force applied by the straps that tend to want to cause the cover to move upwardly relative to the boat. This advantageously minimizes relative cover movement. Where the boat and cover are experiencing applied force due to high or heavy winds, the vents reduce such applied forces by advantageously reducing the differential between pressure inside the cover and outside the cover. Where the boat and cover are experiencing applied force due to high or heavy windows, windows in the cover section above the foredeck minimize applied force by allowing at least some of the wind to pass through the windows.

DRAWING DESCRIPTION

Preferred exemplary embodiments of the invention are illustrated in the accompanying drawings, in which like reference numerals represent like parts throughout, and in which.

Figure 1:
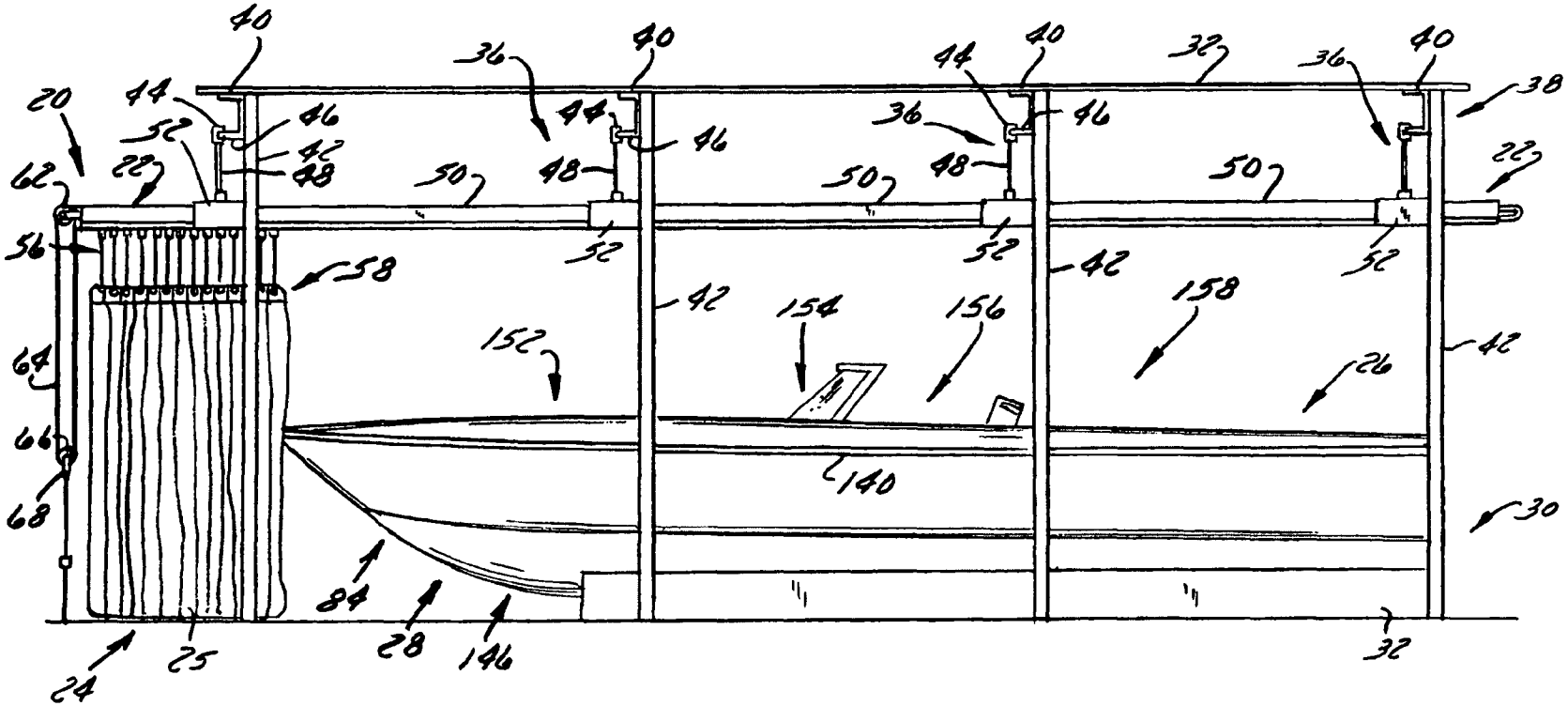
FIG. 1 is a side elevation view of a boat in a slip with a boat cover system that includes a track upon which a boat cover constructed in accordance with the present invention is movably hung and in an open position.

Before explaining embodiments of the invention in detail, it is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION

FIGS. 1-16 illustrate a boat cover system 20 that includes a track 22 along which rides a boat cover 24 constructed in accordance with the present invention so it relatively snugly fits a boat 26 being covered in a manner that better protects the boat 26, that prevents insects and other debris from getting under the cover 24 onto a hull 28 of the boat 26, and that maximizes the life of the cover 24. A boat cover 24 constructed in accordance with the present invention fits the boat 26 in a manner where the cover 24 and boat 26 move substantially in unison despite being subjected to wind and waves while the cover 24 is attached to the track 22. In at least one embodiment, the boat cover 24 is detachable from the track 22 so it can remain covering the boat 26 during transport or storage at a location away from the water.

The boat 26 is shown in a slip 30 of a dock 32 that has a roof 34 overlying the dock 32 and the boat 26, when in the slip 30. The boat cover system 20 employs a plurality of spaced apart track hangar assemblies 36 that are attached to or otherwise carried by part of an existing framework 38 of or for the dock roof 34. For example, in the drawing figures, each track hangar assembly 36 is attached to spaced apart beams 40 that underlie and support the roof 34. The roof support beams 40 extend generally horizontally and are attached to vertically extending posts 42 that extend upwardly from the dock 32 on either side of the boat 26. As is shown in the drawing figures, each track hanger assembly 36 includes a clamp 44 that attaches to a leg 46 of one of the roof support beams 40 from which a connecting rod 48, such as a tie rod or the like, extends. The connecting rod 48 attaches to a track-coupling collar 52 into which opposed ends of sections 50 of track 22 are telescopically received. If desired, other types and configurations of track hanger assemblies can be used.

While a dock roof 34 is shown in the drawing figures, it is contemplated that a boat cover 24 constructed in accordance with the present invention can be used with boat docks lacking a roof. For example, it is contemplated that the boat cover 24 can be used as part of a boat cover system that includes track-supporting framework (not shown) that is installed at the time of installation of the rest of system. Such track-supporting framework can include vertically extending posts and horizontally extending beams similar to the framework 38 used to support the dock roof 34 shown in the drawing figures. Of course, it is contemplated that other track-supporting framework arrangements, including dedicated track-supporting framework arrangements, can be used.

Figure 2:
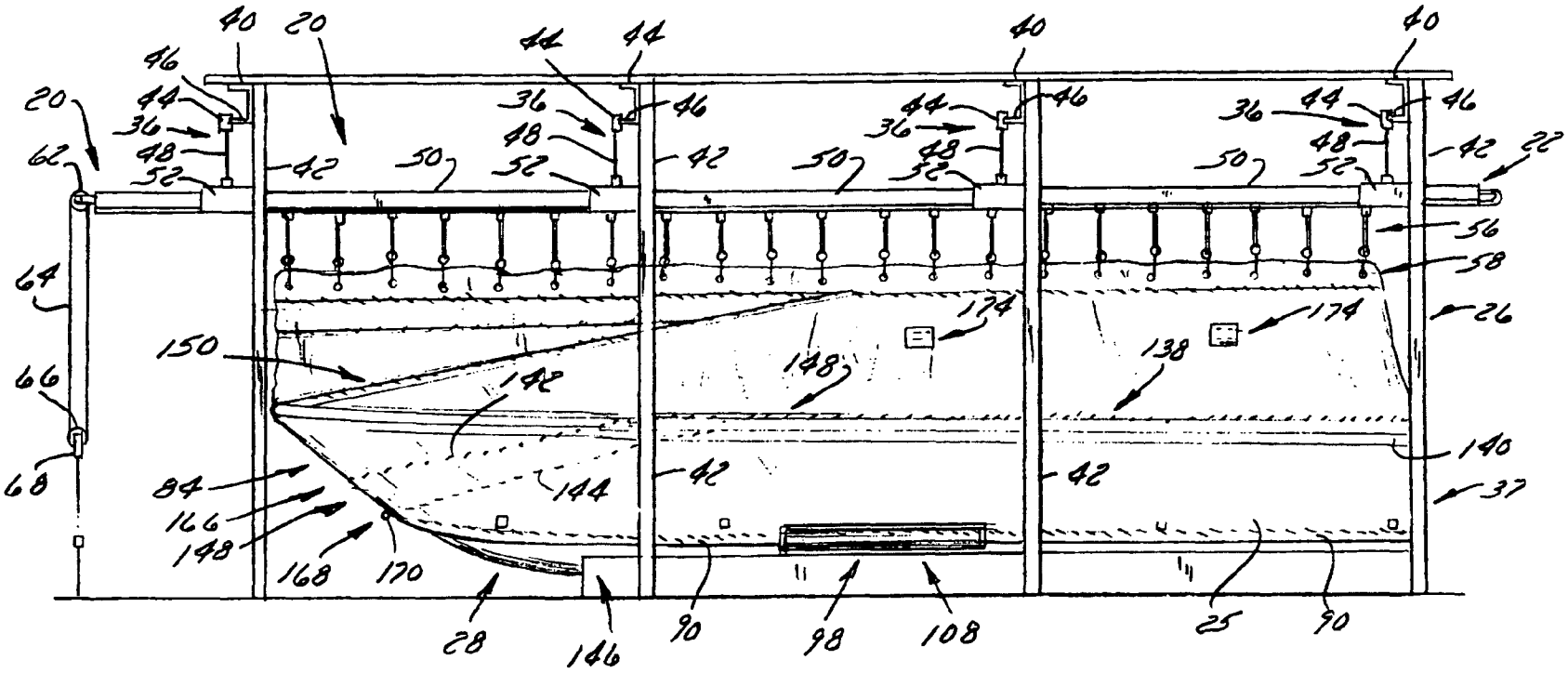
FIG. 2 is a side elevation view of the boat cover system with the cover in a closed position covering the boat.

Referring again to FIG. 1, the track 22 extends the length of the boat 26. The track 22 extends forwardly of the bow of the boat 26 a sufficient length thereby enabling the cover 24 to be moved to an out-of-the-way cover storage position, such as is shown in FIG. 1. The track 22 extends at least to the stern of the boat 26 thereby enabling the cover 24 to be moved from the storage position shown in FIG. 1 to a covered position where the cover 24 encompasses the entire boat 26, such as is shown in FIG. 2. As is shown in FIGS. 1 and 2, the track 22 can extend outwardly beyond the stern of the boat 26.

The cover 24 is attached by a suspension arrangement 54 that includes a plurality of pairs of hanger straps 56 that each have one end connected to a top reinforced section 58 of the cover 24 and each have an opposite end attached to rollers 60 (FIG. 6) that engage the track 22. The rollers 60 can be fixed to a line or cord (not shown) that extends around a driven pulley 62 that is driven by a manipulable operating cord 64 that extends around a drive pulley 66 carried by a yoke 68 anchored to the dock 32 that can be of a construction similar to a traverse-rod type curtain drive system. Such a track and roller arrangement can be constructed the same as or similar to the track and roller arrangement shown and disclosed in U.S. Pat. No. 7,194,976, the entire disclosure of which is expressly incorporated herein. If desired, no cords or lines need be used as the cover 24 can be pulled by a user with the hanger straps 56 pulling rollers along the track 22 between the storage and covered positions as the user walks along the boat 26 from the bow to the stern.

Figure 6:
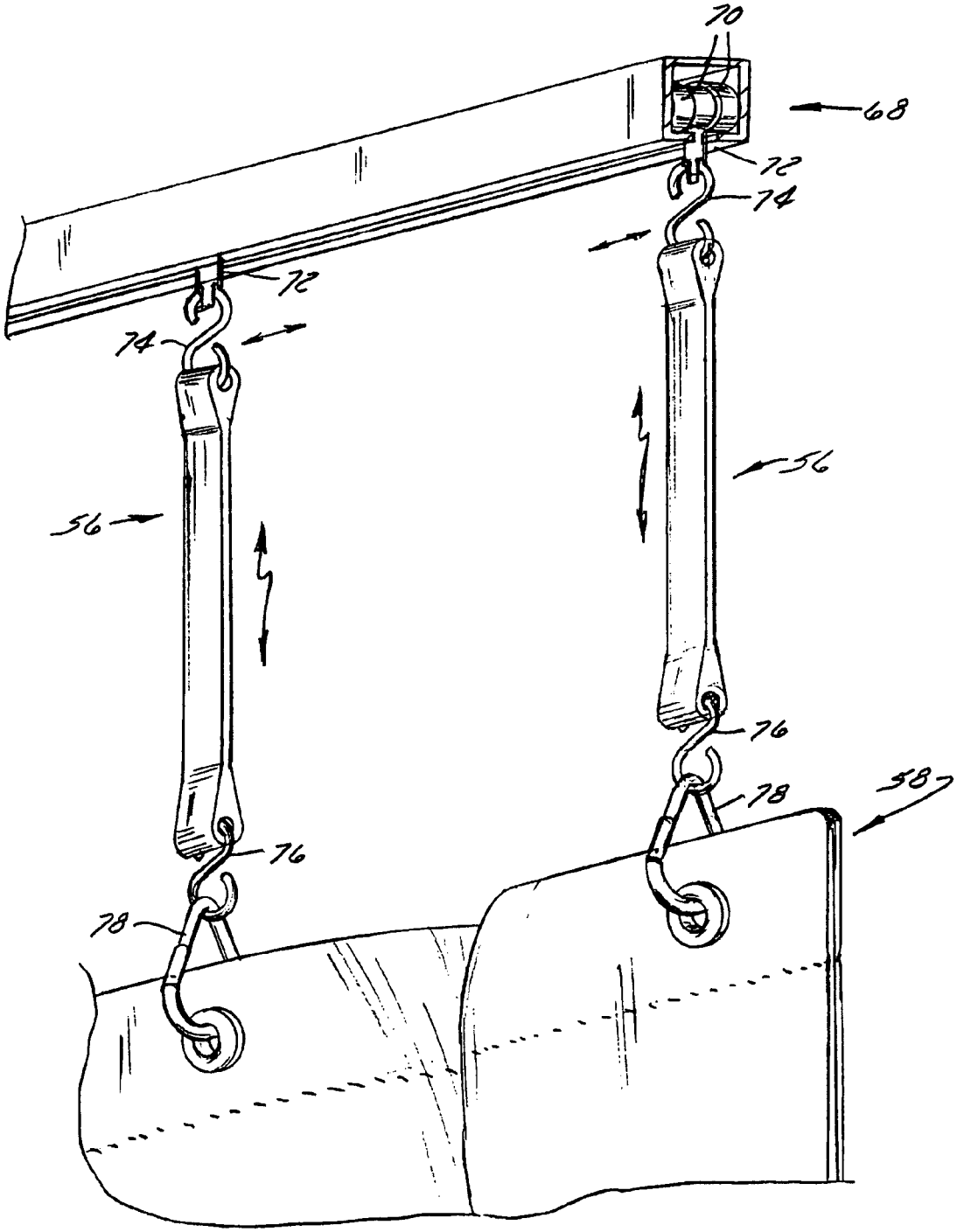
FIG. 6 is an enlarged perspective fragmentary view of a top portion of the cover illustrating a reinforced top segment of the cover hanging by hanger straps from carrier tabs hanging from rollers that engage an overhead track.

With reference to FIG. 6, each roller 60 includes a pair of wheels 70 between which downwardly extends a hanger tab 72 to which an upper hook 74, such as the S-shaped hook shown, is engaged. The upper hook 74 is attached to the hanger strap 56, which is attached by a lower hook 76, such as another S-shaped hook, to a shackle or link 78 that is attached to the reinforced track attachment enabling section 58 of the cover 24. Shackle or link 78 extends through a reinforcing grommet 80 in the reinforced cover section 58.

The strap 56 is constructed and arranged to be able to elongate when placed under tension, e.g. stretched, to accommodate boat displacement due to the force of wind acting on the boat cover 24 and/or boat 26 as well as displacement of the boat 24 and cover due to wave action or the like. As such, each strap 56 is preferably made of an elastic or elastomeric material. As a result, displacement of the boat 26 outwardly away from the track 22 to the point where the strap 56 is in tension causes the strap 56 to stretch to keep the cover 24 moving downwardly in unison with the boat 26. This advantageously prevents boat cover wear and tear as well as helping to ensure that a tight fit between the cover 24 and the boat 26 is maintained in a wide variety of wind and wave conditions. In the preferred embodiment shown in the drawing figures, the strap 56 is composed of rubber, such as EPDM (ethylene propylene diene monomer rubber) or another suitable elastic or elastomeric material. In one preferred embodiment, the strap 56 is an elastic or elastomeric bungee cord.

FIG. 2 illustrates the cover 24 extended to the covered position and attached to the boat 26 in a relatively, tight fitting, snug manner such that the boat 26 and cover 24 move substantially in unison when the boat 26 is moved side to side and up-and-down due to wave and wind action. As a result of a cover 24 constructed in accordance with the present invention be configured to snugly fit the boat 26 to which is attached when covered, insects and other debris cannot get between the cover 24 and hull of the boat 26 thereby keeping the boat 26 cleaner. In addition, by minimizing and preferably substantially preventing relative movement, e.g. rubbing, between the cover 24 and the boat 26 from occurring, boat cover life is maximized and damage to the hull of the boat 26 is minimized.

To help achieve such a desirably snug fit, the cover 24 is tailored based upon the shape of the hull 28 of the boat 26. For example, in the preferred cover embodiment shown in the drawing figures, the cover 24 is cut, configured and sewn to conform the shape of the boat hull 28. In this regard, the cover 24 is custom fitted to the hull 28 based upon the boat type and/or hull type. Examples of hulls suitable to which a cover 24 constructed in accordance with the present invention can be adapted to cover include planing and displacement hulls, such as flat bottom boats, round bottom boats, deep-V hull boats, tri-hull or cathedral hull boats, tunnel hull boats, tunnel vee hull boats, vee hull boats, and pontoon boats.

With reference to FIGS. 3A, 3B, 4 and 5, the cover 24 has a pair of sides or panels 25, 27 that go around corresponding port and starboard sides 29, 31 of the boat 26 when the cover 24 is being maneuvered to cover the boat 26. The panels 25, 27 can be formed of two pieces of material joined together along the front of the cover 24 to form a fold line that is located at the bow of the boat 26 when put on the boat 26. In another cover embodiment, the panels 25, 27 can be formed of a single piece of fabric or material that has a fold line or is folded or bent about the bow of the boat 26. The cover 24 is made of a durable, weather resistant fabric or material, like polyester or woven acrylic. If desired, depending on the climate and other factors, the cover 24 can less preferably be made of canvas, such as cotton canvas or polyester canvas, a polyester-cotton blend, or vinyl with a denim backing.

Figure 5:
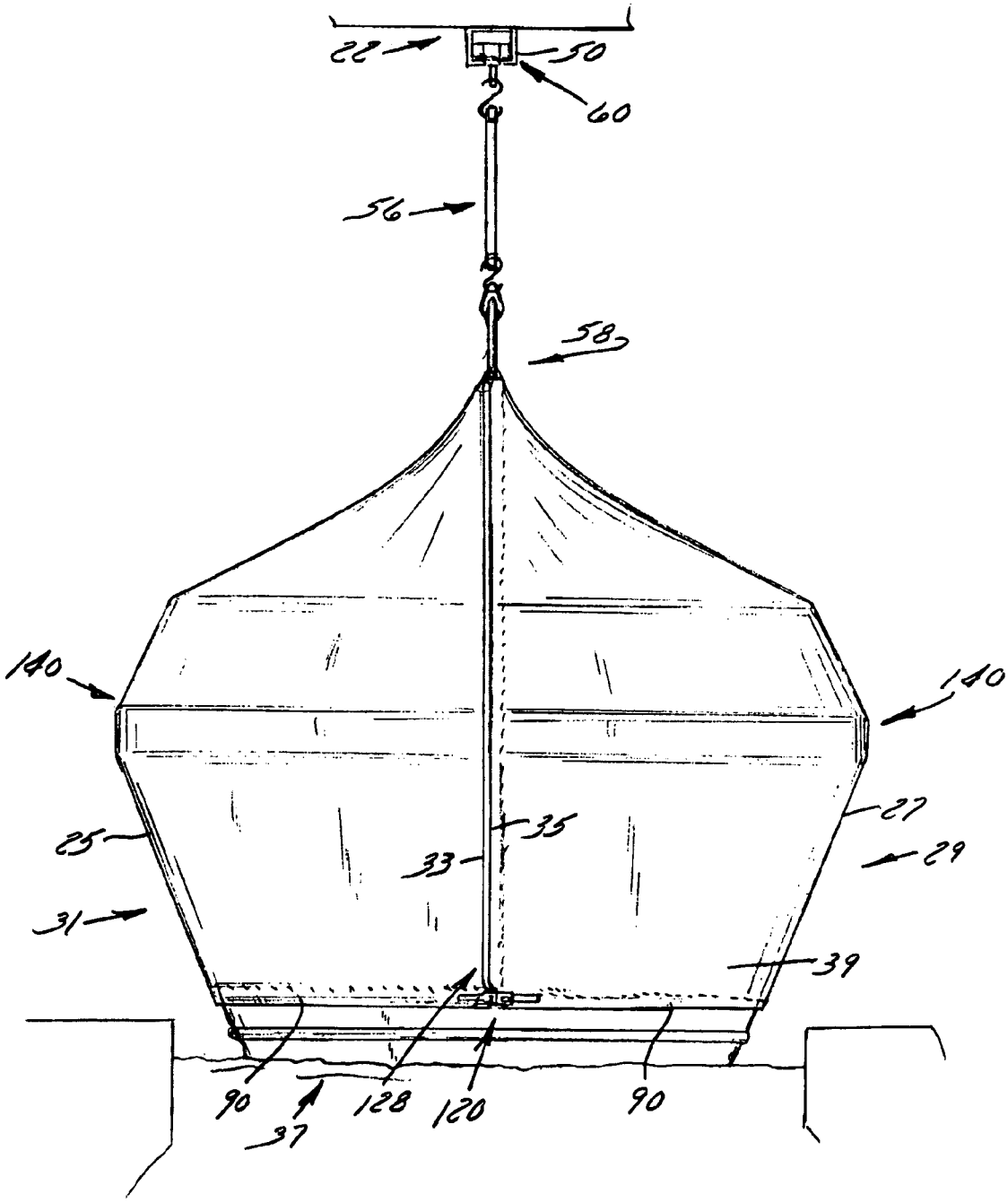
FIG. 5 is a rear elevation view of the boat with the cover attached and a releasable fastener arrangement closed, joining together a pair of panels that form the cover along the rear panel edges.

As is shown in FIG. 5, rear edges 33, 35 of each side 29, 31 engage to secure the cover 24 around a stern 37 of the boat 26. The combination of being able to tighten a bottom skirt 39 of the cover 24 around the hull 28 along with strategically located hemming and seams enable the cover 24, as discussed in more detail below, to be form fitted to the hull 28 of the specific type of boat for which the cover 24 is designed to cover.

As is best shown in FIGS. 2-5, the cover 24 includes a bottom hem region 80 that includes a hem 82 that extends along a bottom edge or margin of the cover 24. The cover 24 is configured so the bottom edge of the cover 24 is disposed above the water in the slip 30 so that water will not be drawn between the cover 24 and boat hull 28. The bottom hem region 80 can be composed of an elastic material that can be disposed within an interior surface of a layer of fabric or material from which the cover 24 can be constructed. This can be or can include an elastic gathering or shirring that extends along or about the bottom edge of the cover 24. For example, one or more strips of elastic gathering or shirring can be sewn into an interior surface of the cover 24. In one embodiment, elastic gathering or shirring material extends at least along the bottom edge of the cover 24 along at least the bow 84 of the boat hull 28 and can extend along a portion of each side of the hull 28 as well. In one embodiment, such elastic gathering or shirring material extends substantially about the entire bottom periphery of the cover along the front and both sides of the boat hull 28. Elastic gathering or shirring material can also be attached to the cover 24 above the bottom hem region 80 in addition to or in lieu of elastic gathering or shirring material in or along the bottom hem region 80.

The use of such elastic gathering or shirring advantageously helps pull the bottom portion of the cover 24 against the hull 28 thereby preventing debris, insects and other objects from getting between the cover 24 and hull 28 along the bottom edge of the cover 24. In addition, this helps frictionally retain the cover 24 on the hull 28 in a manner that helps ensure that the cover 24 will move substantially in unison with the boat 26 as the boat 26 bobs up and down and rocks back and forth due to wave action. Such frictional retention also minimizes relative movement between the cover 24 and boat 26 thereby minimizing wear and tear of the cover 24 and/or boat 26 that occurs with prior art covers.

Figure 3A:
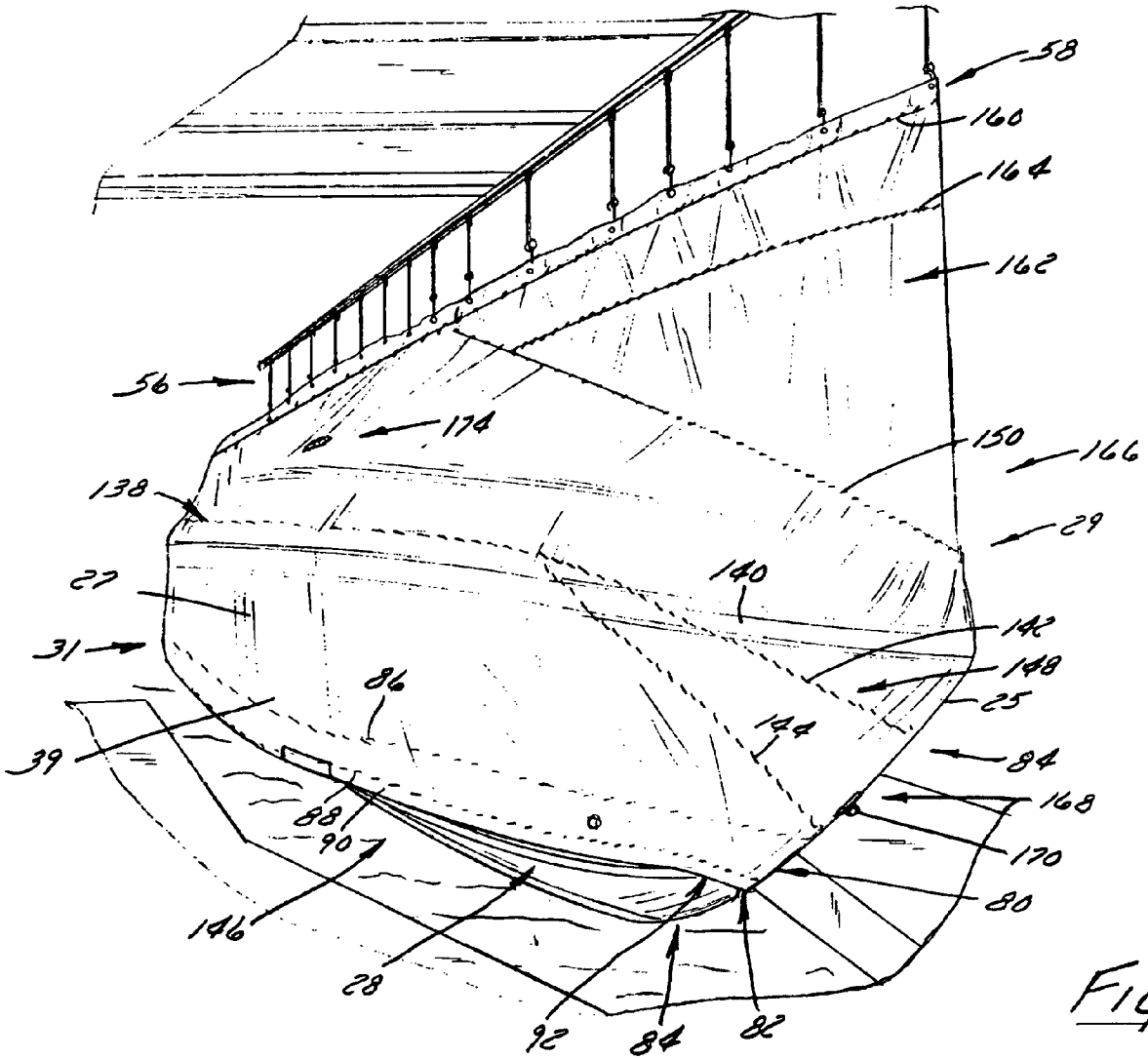
FIG. 3A illustrates a front perspective view of the boat and cover with the cover covering a front or fore section of the boat with a fitting seam tracking a foredeck or top-front portion of the boat.
Figure 3B:
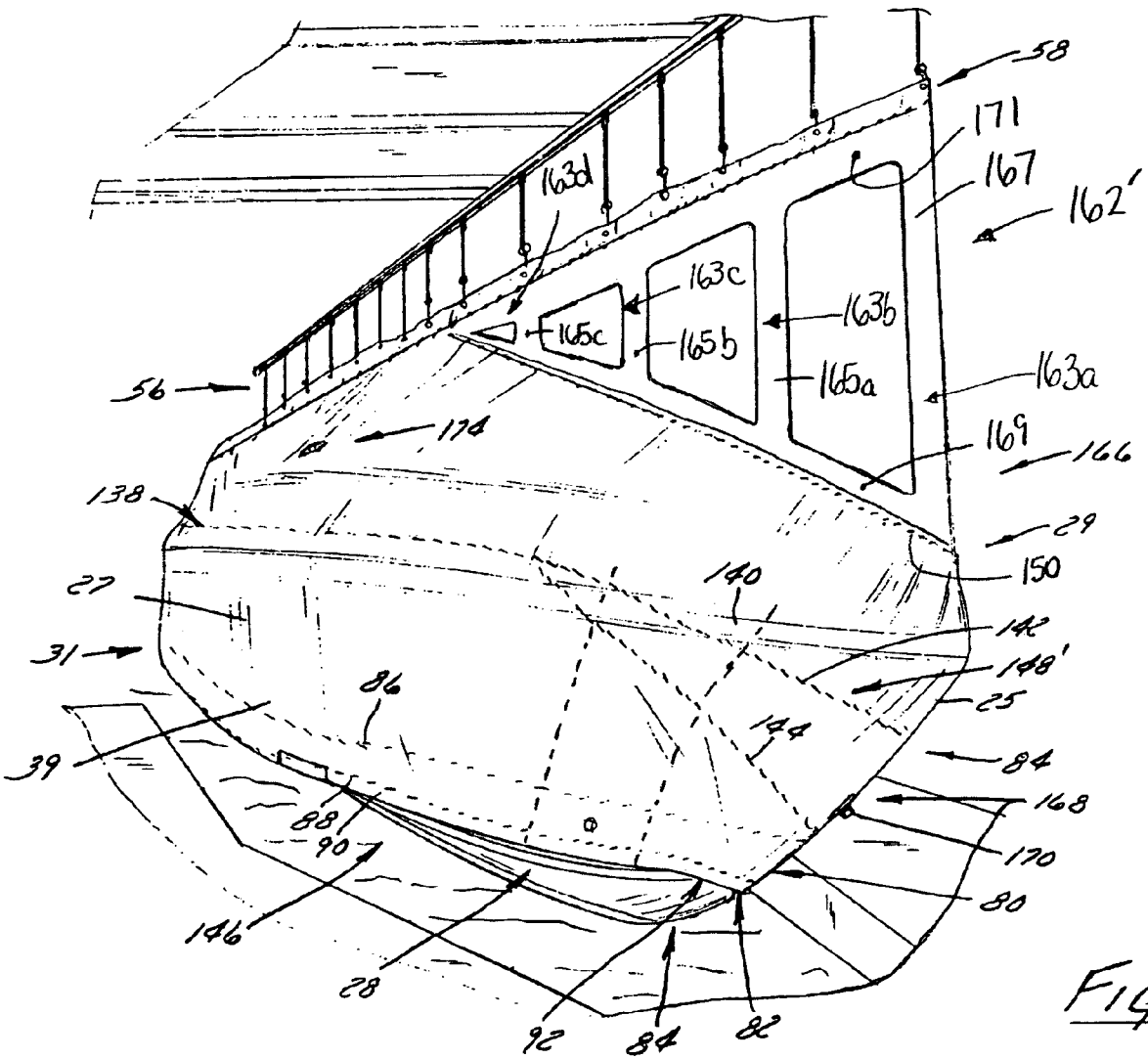
FIG. 3B illustrates a front perspective view of a second preferred embodiment of a boat cover constructed in accordance with the present invention that includes windows in a section of the boat cover overlying the foredeck and/or windshield that interconnects the cover with a reinforced track-attached boat cover section.

As is best shown in FIGS. 3A and 3B, the bottom hem region 80 is defined by a pair of elongate side-by-side seams 86, 88 that extend at least along the bow 84 of the hull and along at least a portion of each side of the hull 28 as in the manner discussed above. The upper seam 86 helps constrain material of the cover 24 so it bounds the hull along its bottom edge in a manner that facilitates a tailored, snug fit.

Figure 7:
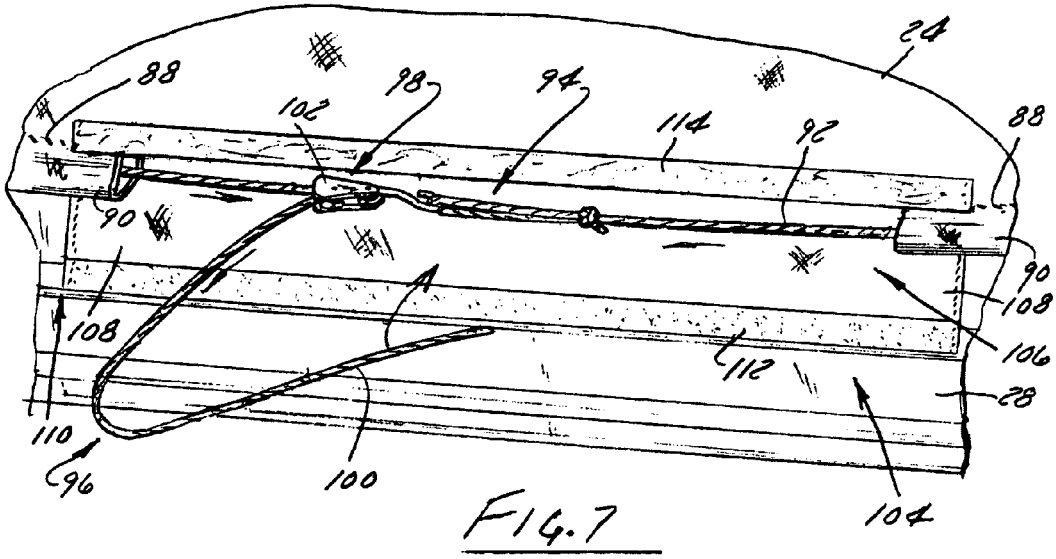
FIG. 7 is an enlarged fragmentary front elevation view of an access pocket in the cover in which a cinching arrangement is disposed.

With additional reference to FIGS. 7-12, the lower seam 88 defines or helps define an elongate sleeve 90 in the form of a hem in which a cinching rope 92 of a cover cinching harness arrangement 93 (FIG. 12) is threaded about the entire lower periphery of the cover 24. The rope 92 is slidably, telescopically threaded within the sleeve 90. With reference to FIG. 7, a pair of ends 94, 96 of the cinching rope 92 are shown coupled to a cinching arrangement 98 used to tighten the rope 92 and thereby cinch the bottom of the cover 24 tightly against the outer surface of the hull 28 to cause the cover 24 to at least snugly fit along the lower periphery of the cover 24. To tighten or cinch the rope 92, a user pulls on a handle 100, formed by one end 96 of the rope 92 causing the cinching arrangement 98 to releasably retain the rope 92 in a tightened or cinched condition. The cinching arrangement 98 can be equipped with a release (not shown) that facilitates loosening of the rope 92, such as when it is desired to remove the cover 24 from the boat 26.

In a preferred embodiment, the cinching arrangement 98 is a ratchet 102, such as a ROPE RATCHET made or distributed by Carolina North Manufacturing of 1325 South Park Drive, Kernesville, N.C. Such a ratchet is shown and described in U.S. Pat. Nos. 5,368,281 and 5,722,640, the disclosures of each of which are hereby expressly incorporated herein by reference. Such a ratchet 102 can be configured to enable release of the cinching arrangement 98. If desired, another type of cinching arrangement can be used. For example, such as where the rope 92 is replaced by a strap, cable or a different type of line, a different type of cinching arrangement can be used. Though a strap, cable or different type of line can be used, rope, such as nylon rope, is preferred because it is inexpensive, easy to use and manipulate, strong, durable, weather resistant, and resistant to the adverse affects of being in a lake, river or ocean environment.

Figure 8:
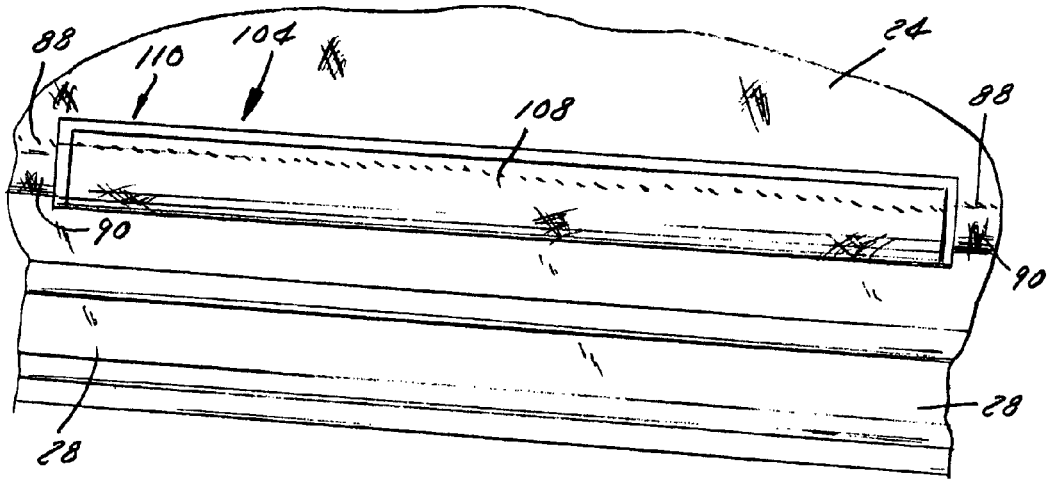
FIG. 8 is an enlarged fragmentary front elevation view of the cinching arrangement access pocket with a flap overlying the access pocket.

As is shown in FIGS. 7 and 8, the cinching arrangement 98 is accessible via an access pocket 104 that is formed by a cutout 106 in the sleeve 90 that is covered by a flap 108 when not in use. The flap 108 is releasably attachable to part of the cover 24 along at least the top of the cutout 106. If desired, it can also be releasably attachable along one or both sides. An attachment arrangement 110 enables the flap 108 to be opened and closed as desired. As is shown in FIG. 7, the opened flap 108 has at least one strip 112 of a hook and loop fastener that engages with a strip 114 of hook and loop fastener that extends above the cutout 106. When the flap 108 is closed, such as is shown in FIG. 8, the cinching arrangement 98 and rope 92 are covered and thereby advantageously protected from the environment.

Figure 9:
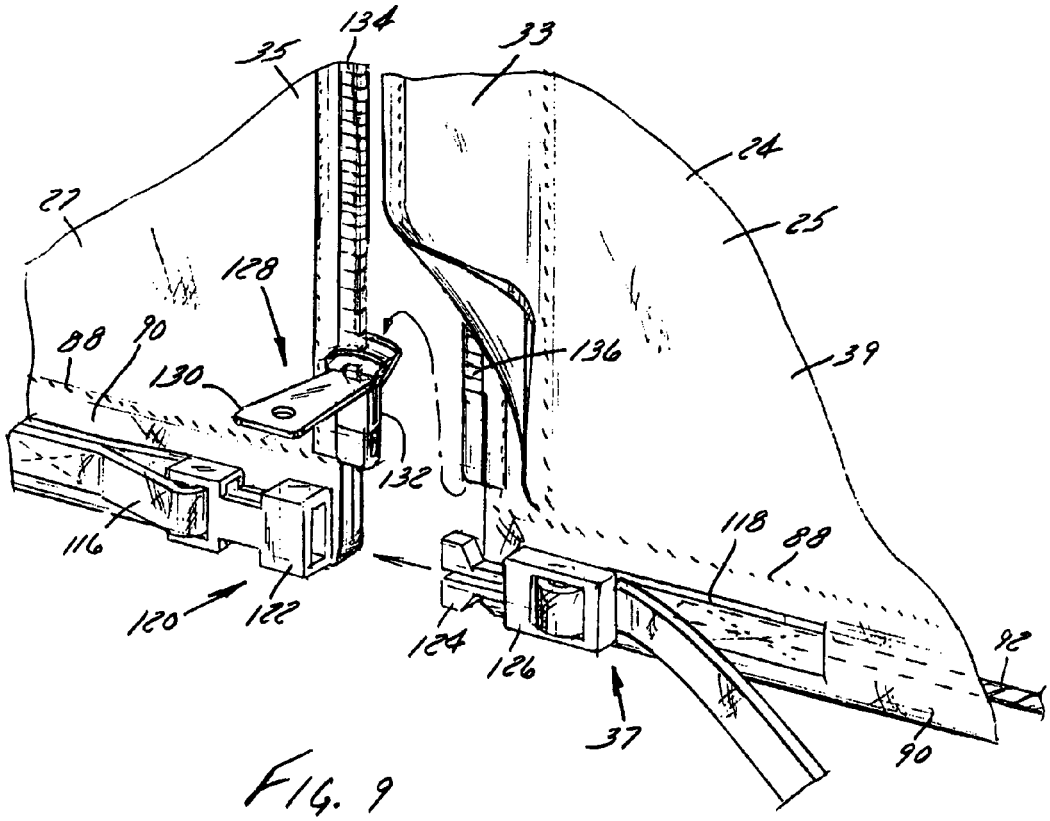
FIG. 9 is an enlarged fragmentary perspective view of a rear portion of the cover that is disposed along the stern of the boat illustrating a releasable fastening arrangement used to join the rear edges of the cover panels in an open position.
Figure 10:
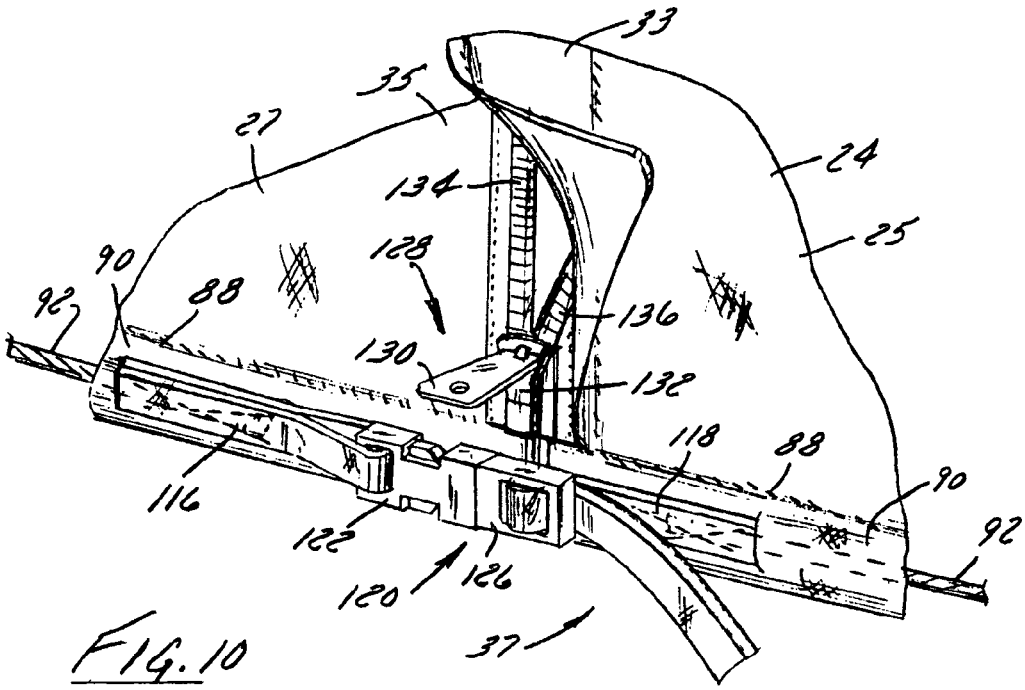
FIG. 10 is the enlarged fragmentary perspective view of the rear portion of the cover of FIG. 9 with the fastening arrangement beginning to join the cover panels together along their rear edges.
Figure 11:
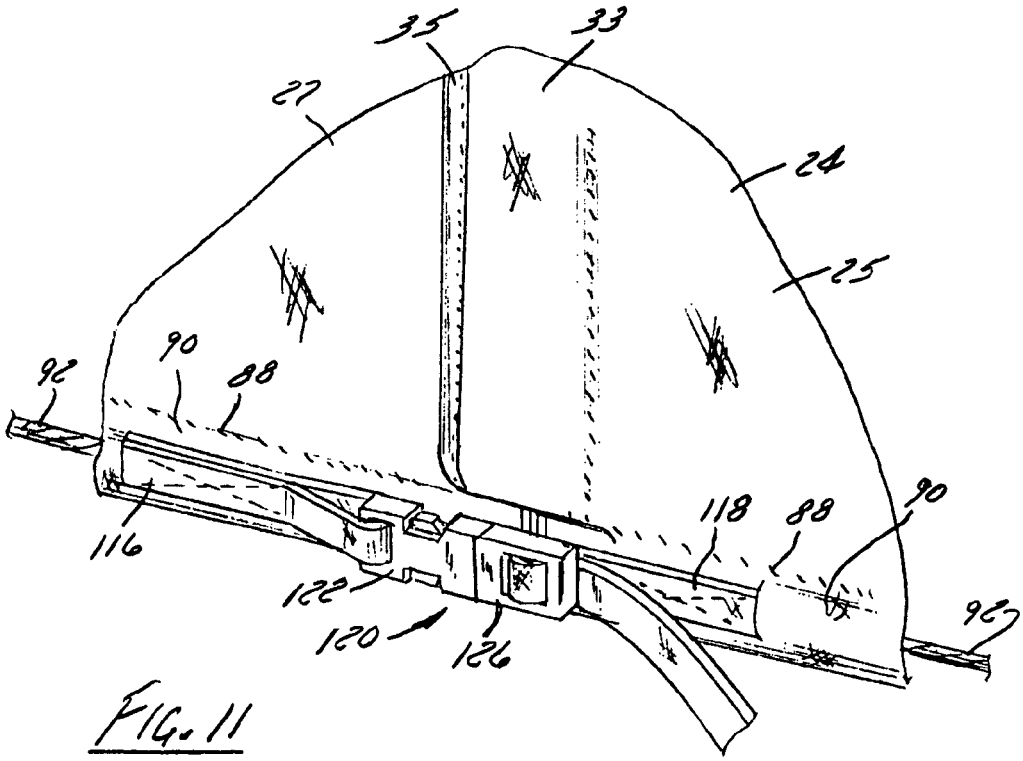
FIG. 11 is the enlarged fragmentary perspective view of the rear portion of the cover of FIG. 9 with the fastening arrangement closed.

With reference to FIGS. 9-11, the rope 92 has a pair of ends along the stern 37 of the boat 26 that are each fixed to a strap segment 116, 118 that each is attached to a portion of a releasable latching arrangement 120 that enables the cover cinching harness arrangement 93 to be of releasable construction facilitating removal of the cover 24 from the boat 26. In the preferred embodiment shown in FIGS. 9-11, the releasable latching arrangement 120 is a buckle of side release construction having a buckle socket 122 that releasably receives a pronged tongue 124 of a male buckle plug 126. It is contemplated that in at least some instances, the strap segments 116, 118 may not be needed such as where the releasably latching arrangement 120 is constructed and arranged to accept one end of the rope 92.

Figure 12:
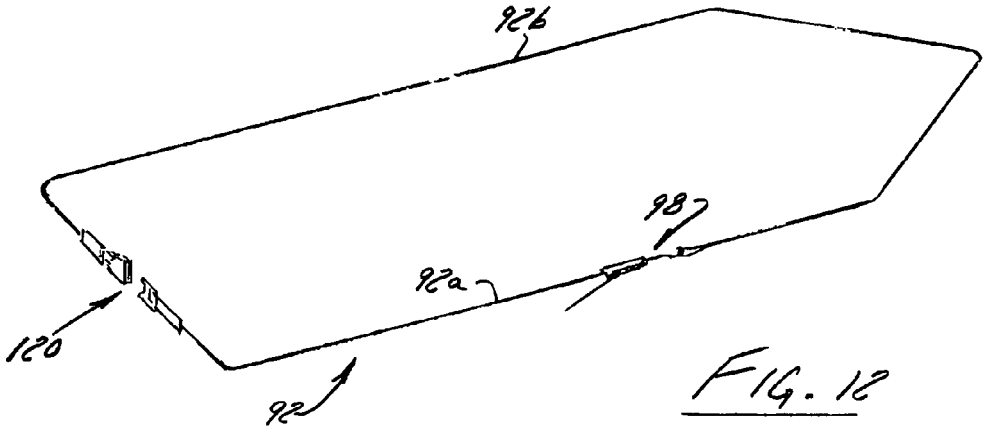
FIG. 12 is a perspective view of the cinching arrangement and line that extends about the bottom periphery of the boat cover enabling the cover to be snugly tightened against the hull about its bottom periphery.

The boat cover cinching harness arrangement 93 is shown in FIG. 12 isolated from the rest of the boat cover 24. The cinching harness arrangement 93 includes a plurality of rope segments 92*a* and 92*b* that attach to the releasable latching arrangement 120 when the cover 24 is covering the boat 26 thereby enabling the cinching arrangement 98 to tighten the rope segments 92*a* and 92*b*. As the rope segments 92*a* and 92*b* are tightened, they pull the bottom edge of the skirt 39 of the cover 24 tightly against the hull 28 of the boat 26.

To enable the boat cover panels 25, 27 to be secured to one another along their rear edges 33, 35 when securing the cover 24 around the stern of 37 of the boat 26, there is a releasable fastener arrangement 128, such as a zipper. In the preferred embodiment shown in FIGS. 9-11, the zipper 128 is a nylon zipper, such as a nylon zipper of double-pull construction. Although not shown, a line can be attached to a tab 130 of the zipper 128 to facilitate movement of a zipper slide 132 along the teeth 134, 136 of the zipper 128 along the length of the cover edges 33, 35. For example, a loop of line (not shown) with a portion of the line attached to the zipper tab 130 can be manipulated by a user to zip the zipper closing the cover edges together or to unzip the zipper separating the cover edges allowing the cover 24 to be removed.

When closed, one of the edges can overlap the other one of the edges such as in the manner shown in FIG. 11. Although not shown, an edge fastener arrangement can be used to releasably secure the edges 33, 35 together on top of the zipper 128 along where they overlap. One preferred edge fastener arrangement is a strip of a hook and loop fastener (not shown) attached to an inner surface of one cover edge 33 that is capable of engaging another strip of a hook and loop fastener arrangement (not shown) attached to an outer surface of the other cover edge 35.

The cover 24 has a middle seam region 138 along each cover panel that extends along and above the gunwale 140 of the boat 26 that is formed of a plurality of seams 142, 144 that each extend downwardly and diverge along the side of the boat 26 at a fore section 146 of the bow 84 forming a lower fore fitting seam section 148. In one preferred embodiment, only one of the fitting seams 142 or 144 is used. Fitting seams 142, 144 continue to diverge from one another in the lower fitting seam section 148 until they reach the bow 84 such that the upper seam 142 of one cover panel 25 in fitting seam section 148 meets or connects with the upper seam 142 of the other cover panel 27 in fitting seam section 148 and the lower seam 144 of the one cover panel 25 in fitting seam section 148 meets or connects with the lower seam 144 of the other cover panel 27 in fitting seam section 148. With reference to FIG. 3, the fitting seam section 148' can also include one or more generally vertically extending fitting seams 143 and 145. In the preferred embodiment shown in FIG. 3, there are a plurality of spaced apart vertical fitting seams 143 and 145 on each side. The lower fitting seam section 148 or 148' helps gather the boat cover material and tailor so it helps to custom form fit each cover panel 25, 27 about the hull 28 of the boat 26, particularly along its fore section 146 and bow 84, when the cinching arrangement 98 has been tightened and the zipper 128 zipped up. As a result of at least the lower fitting seam section 148 or 148' helping to make the cover 24 more form fitting, the cover 24 fits tighter on the boat 26 which helps minimize and prevent movement of the cover 24 relative to the boat 26.

Above the middle seam region 138 is an upper fitting seam 150 that extends from at or adjacent the reinforced cover region 58 near the middle of the boat 26 downwardly at an angle so it tracks at least a portion of the foredeck 152 and windshield 154 (FIG. 1) of the boat 26 thereby helping to further more tightly custom fit the cover 24 onto the boat 26 as well as to minimize the amount of cover material overlying the foredeck 152, cab 156 (FIG. 1) and interior 158 (FIG. 1) of the boat 26 that can billow or undulate in response to wind blowing over the cover 24 and boat 26. With reference to FIGS. 1-3A and 3B, the upper fitting seam 150 extends substantially linearly from adjacent the top of the windshield 154 to adjacent where the foredeck 152 and bow 84 converge at the very front of the boat 26. A boat cover constructed in accordance with the present invention can be configured to cover a boat with a cabin (not shown) by configuring the fitting seam 150 so it extends from the front of the cabin to adjacent the front of the boat.

These fitting seams 148 and 150, combined with the fact that the panels 25 and 27 are interconnected along the front of the cover 24, produce a cover 24 that fits the front of the boat 26 like a "glove." The addition of the cinching arrangement and cinching bottom hem region 80 produces a cover 24 enables the cover 24 to advantageously fit like a "glove" about the prow of the hull 28 of the boat 26. By producing a boat cover 24 that fits the boat 26 it is covering like a "glove," relative movement of the cover 24 relative to the boat 26 is minimized and preferably substantially prevented when the boat 24 is in the slip 30. This prevents cover wear and rubbing of the cover on the boat hull.

The seam 160 that defines the reinforced track attachment enabling region 58 and the upper fitting seam 142 define a triangular section 162 of the cover 24 where the two cover panels 25, 27 are joined together forming a generally triangular deflector region 162 of unitary construction that helps deflect upwardly wind impinging against the upper half of the cover 24. The cover 24 can also include a cover panel joining seam 164 that is generally parallel to the reinforced region seam 160 and which is located between the reinforced region seam 160 and the upper fitting seam 150. The cover panel joining seam 164 joins the two cover panels 25 and 27 together up to where they adjoin at the front of the cover 24 thereby preventing the panels 25, 27 from billowing in the deflector region 162 when wind impinges against the deflector region 162 of the cover 24. The net result is a substantially unitary deflector region 162 that resiliently deflects wind impinging against the cover 24 and boat 26 while not billowing or otherwise flapping around.

FIG. 3B illustrates another preferred boat cover embodiment where the triangular section 162' that extends above the foredeck 152 and/or windshield 154 is of perforate construction. The triangular section 162' connects that portion of the cover extending along the foredeck 152 and/or windshield 154 to the reinforced track attachment enabling section 58 thereby supporting the cover therealong. The triangular section 162' has at least a plurality of pairs of wind-passage windows 163*a*, 163*b*, 163*c*, and 163*d* that extend therethrough and which are spaced along substantially the entire length of the triangular section 162' allowing at least some of the wind impinging against the cover to pass through. Each window 163*a*, 163*b*, 163*c*, and 163*d* is separated by an elongate strip of flexible material 165*a*, 165*b* and 165*c*, such as the boat cover material disclosed above. There is also an end strip of material 167 framing a portion of the outermost window 163*a*. There can also be top and bottom margins 169 and 171 framing a respective portion of each window 163*a*, 163*b*, 163*c*, and 163*d*. These strips 165*a*, 165*b* and 165*c*, segment 167, and margins 169 and 171 help deflect at least some of the wind while the windows 163*a*, 163*b*, 163*c*, and 163*d* permit wind to pass through thereby reducing the amount of force the wind exerts on the triangular section 162'. Each window 163*a*, 163*b*, 163*c*, and 163*d* can have the shape of a quadrilateral as shown in FIG. 3B. Reducing the force of the wind acting upon the cover helps improve stability of the boat in the dock as well as prevents the wind from damaging or ripping off the cover. In addition, these windows 163*a*, 163*b*, 163*c*, and 163*d* also advantageously prevent wind passing over the boat and boat cover and along the triangular region 162' from exciting the cover into any kind of resonant condition that could cause the force being exerted by the wind on the cover to greatly oscillate or otherwise dramatically surge. In one preferred embodiment, such a windowed section 162' enables the cover to withstand strong gale force winds while remaining attached to the boat. In another preferred embodiment, such a windowed section 162' enables the cover to withstand hurricane force winds while remaining attached to the boat.

In the preferred embodiment shown in FIG. 3B, there are three windows 163*a*, 163*b* and 136*c*. If desired, the triangular section 162' can have more than three windows. For example, a boat cover constructed in accordance with the present invention will include a triangular section 162' typically having between three and eight such windows. In the preferred embodiment shown, the surface area of all of the windows 163*a*, 163*b* and 136*c* is at least sixty percent of the surface area of the section 162' extending between the foredeck 152 and/or windshield 154. In another preferred embodiment, the surface area of all of the windows 163*a*, 163*b* and 136*c* is between seventy percent and ninety percent of the surface area of the section 162'.

Figure 4:
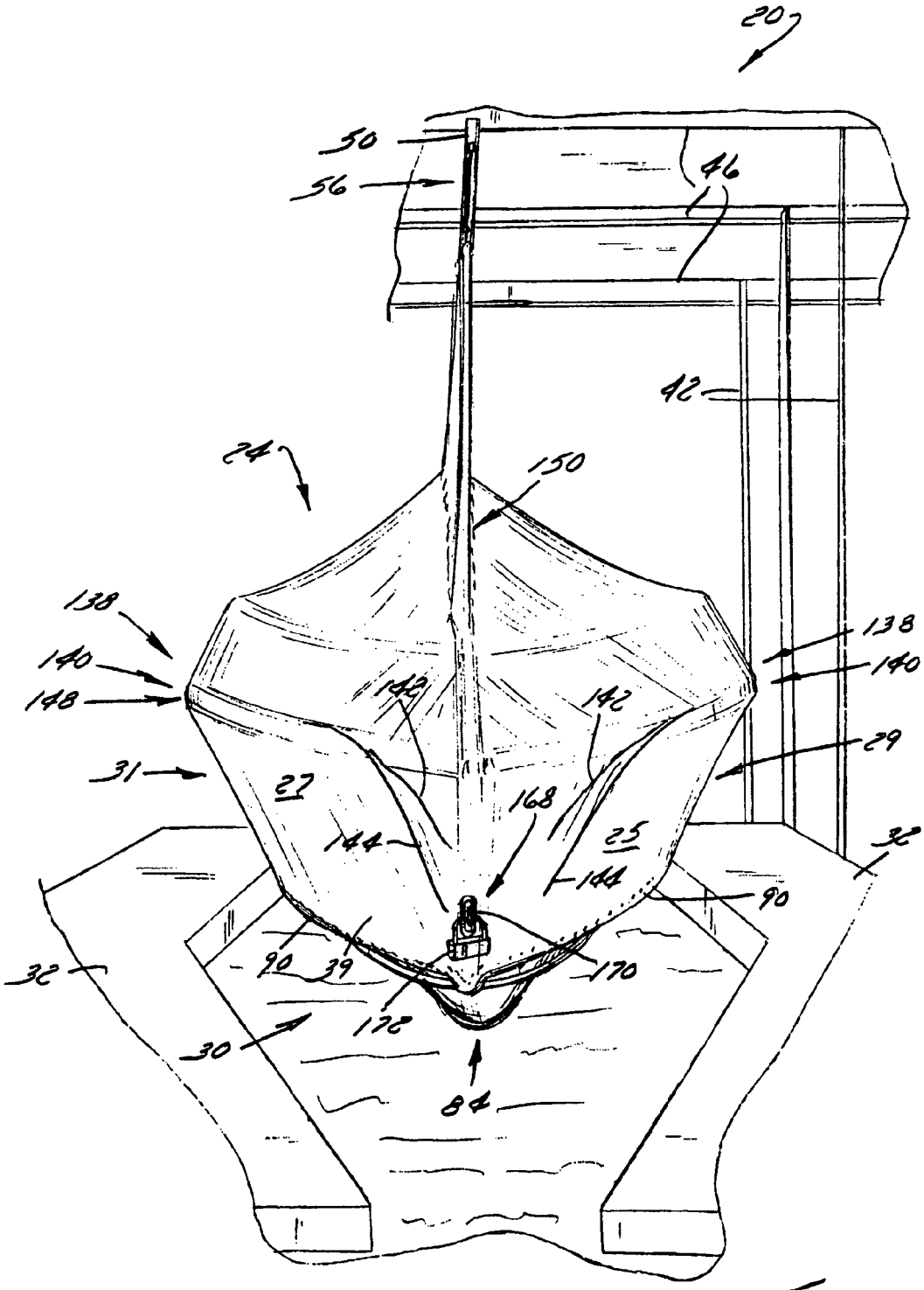
FIG. 4 is a front elevation view of the boat with the cover attached.

As is also shown in FIGS. 2-4, the front 166 of the cover 24 has an aperture 168 through which a cleat or bow eye 170 extends. This enables a security arrangement, such as a lock 172 (FIG. 3A) or cable arrangement (not shown) to be attached to the bow eye 170 thereby securing the cover 24 to the boat 26 in the bow region. In one embodiment, the lock 172 secures a cable arrangement (not shown) that is looped through loops, slots or apertures along each side of the cover to help secure the cover 24 to the boat 26. Such a cable arrangement can extend through the zipper tab 130 or loops, slots or apertures in the overlapping rear cover edges 33, 35 to help secure the cover 24 along the stern 37 of the boat 26.

Figure 13:
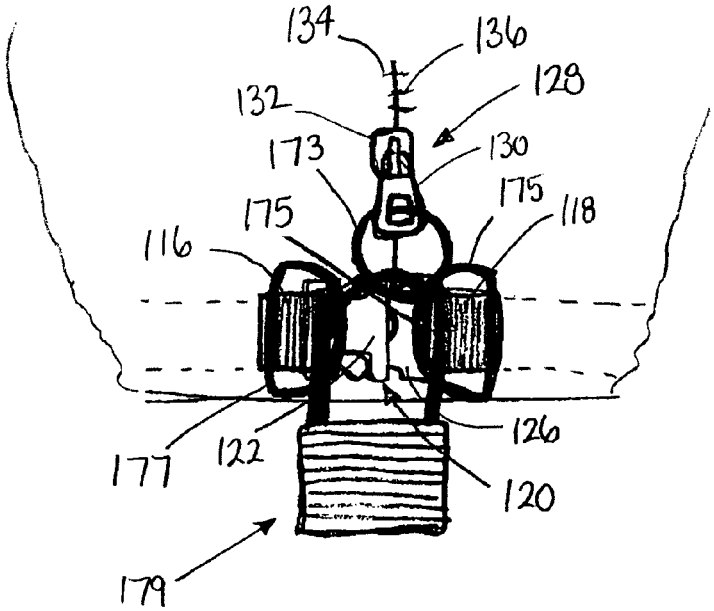
FIG. 13 is a fragmentary front elevation view of a portion of the rear cover fastening arrangement illustrating a preferred embodiment of a security arrangement for securing the cover to a boat.

With reference to FIG. 13, in another embodiment, a lock 179, such as a padlock or the like, is releasably attached to a ring 173 that is attached to the zipper tab 130 and to a pair of D-rings 175, 177 that each are connected to a respective one of the strap segments 116, 118 adjacent buckle socket and plug 122, 126 of buckle 120 to prevent the zipper 128 from being unzipped thereby preventing unauthorized cover removal. By securely attaching the cover 24 to the boat 26 in this manner, the cover 24 advantageously acts as a security device that prevents access to the interior of the boat 26. This can also advantageously prevent removal of the boat 26 from the slip 30.

Figure 14:
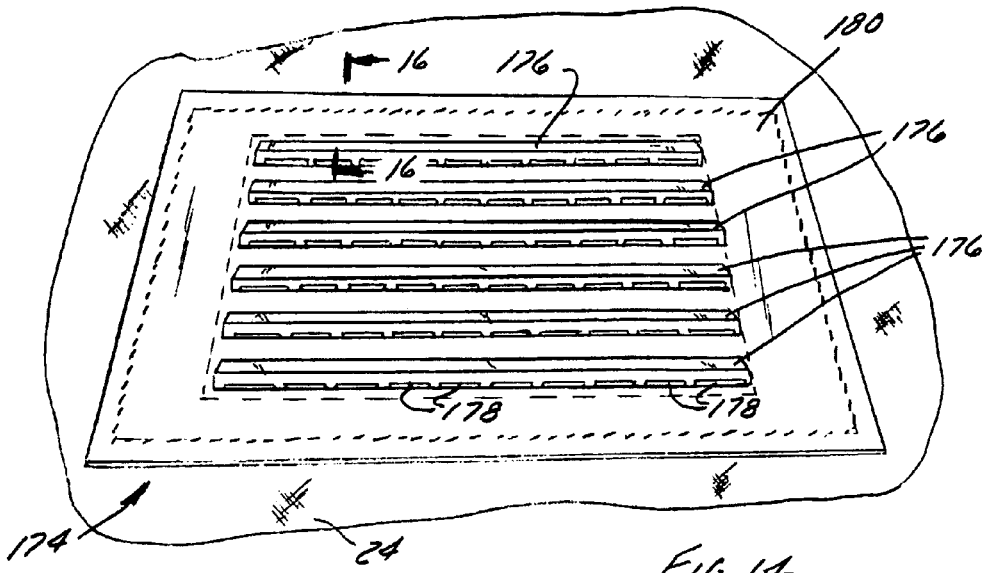
FIG. 14 is a bottom perspective front outside view of a wind-pressure differential reducing vent attached to one of the cover panels.
Figure 16:
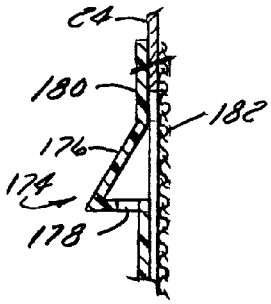
FIG. 16 is a fragmentary cross sectional view of the vent shown in FIG. 14 taken along line 16-16 of FIG. 14.
Figure 15:
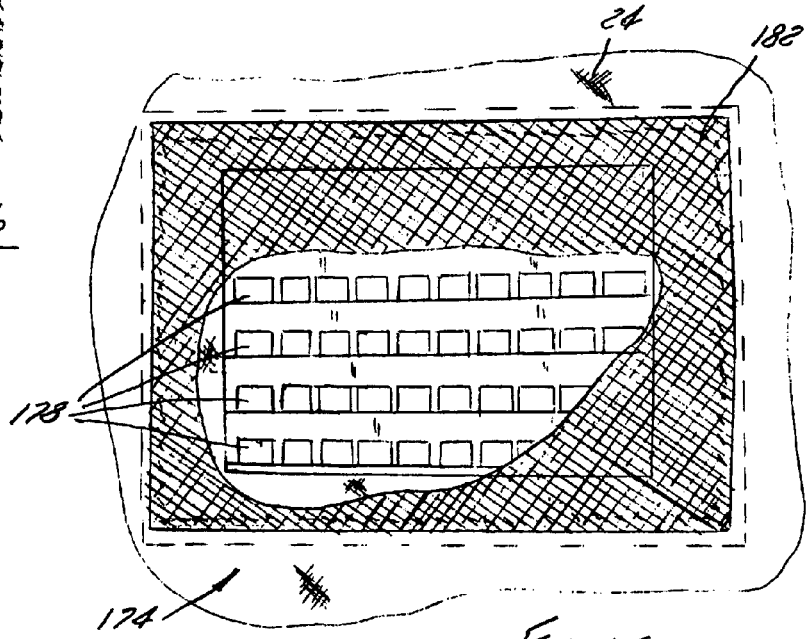
FIG. 15 is a rear elevation view of the vent of FIG. 14.

With reference to FIGS. 14-16, the cover 24 also has a plurality of spaced apart vents 174 spaced apart along an upper half of each boat cover panel 25 and 27. Each vent 174 has a plurality of pairs of spaced apart and angled louvers 176 that each define a plurality of vent through holes 178 through which some of the wind flowing over and around the cover 24 is directed underneath the cover 24 within the space that lies underneath the cover 24 and above the interior, e.g. above the cab or cabin, of the boat 26. Each vent 174 helps equalize the pressure inside the cover 24 with the pressure outside the cover 24. Each vent 174 has a flange 180 about its periphery to which the cover 24 is sewn. To prevent insect and debris from getting inside the cover 24, there is a section of screen 182 underneath each vent 174 that covers the vent 174 that is sewn to the cover 24 about or adjacent the periphery of the vent 174.

Each of the vents 174 are oriented at acute angle relative to horizontal so as to direct wind flowing along and upward over the cover 24 into the interior space underneath the cover. This not only ventilates the interior, which prevents mold and mildew formation, it also reduces the lift associated with wind blowing along and over the cover. Without such vents 174, wind blowing along and across the cover 24 would create a significant pressure differential between the pressure inside the cover 24 versus outside which would exhibit a force tending to want to move the cover 24 relative to the boat 26. By providing vents 174 in the upper half of each cover panel 25 and 27 and spaced apart along the length of the corresponding cover panel, such wind-driven lift is reduced in the very region(s) of the cover 24 most susceptible to flapping or billowing as well as minimizing wind-driven excitation, e.g. resonance, that can also lead to flapping or billowing. By minimizing and preferably preventing such flapping and billowing, relative movement between the cover 24 and boat 26 is advantageously reduced and preferably prevented thereby minimizing wear on both the cover 24 and boat 26.

As is best shown in FIG. 2, each cover panel 25, 27 has a pair of spaced apart vents 174 with one of the vents 174 overlying a rear portion of the boat 26 interior and the other one of the vents 174 overlying a front portion of the boat 26 interior adjacent the windshield 154. In the preferred cover embodiment shown in the drawing figures, the vents 174 are spaced apart so as to reduce the pressure differential along the entire surface of the cover 24 that overlies the interior of the boat 26 where the cover 24 is neither taut nor fitted directly over part of the boat 26, such as the boat hull 28. These areas of the cover 24 that are not fitted or supported directly on part of the boat 26 are most susceptible to wind-driven flapping or billowing, which are the locations where the vents 174 are located. While a pair of vents 174 is shown on each cover panel 25, 27, more than two vents can be used. For smaller boats, a single vent on each cover panel may suffice.

Figure 17:
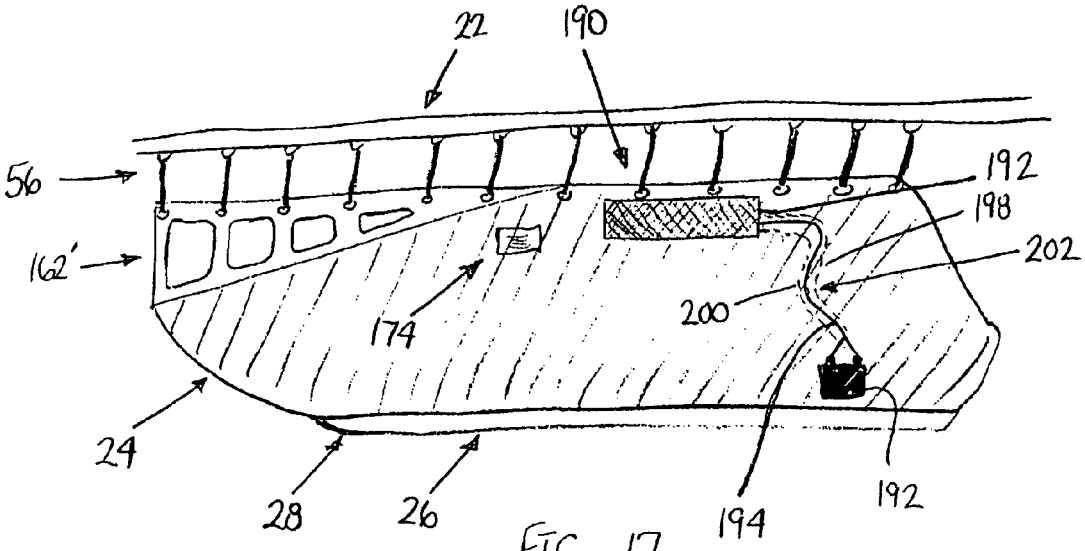
FIG. 17 illustrates a boat cover constructed in accordance with the present invention with an integrated solar power boat battery charger formed as part of the cover.

FIG. 17 illustrates a preferred embodiment of a boat cover 24 with an integrated boat battery charger arrangement 190 integrally mounted thereto. The boat battery charger arrangement 190 includes at least one solar panel 192 connected by a power line 194 to at least one marine battery 196. Such a cover 24 equipped with an integrated charger 190 can be configured with a pair of seams 198, 200 that define an elongate channel 202 in the cover 24 in which the power line 194 extends. In the preferred embodiment shown FIG. 17, at least one solar panel 192 is mounted on one side of the cover 24 to a portion of the cover 24 disposed at an acute generally horizontal angle and at least one other solar panel (not shown) is mounted on the opposite side of the cover 24 to another portion of the cover that is also disposed at an acute generally horizontal angle. By such a mounting arrangement, charging time is optimized because one solar panel supplies electric current to the battery 196 during a substantial portion of the first half of the day and the other solar panel supplies electric current to the battery 196 during a substantial portion of the second half of the day. Such a trickle charging arrangement 190 advantageously helps keep the battery or batteries onboard the boat 26 charged.

With reference to FIG. 1, in use, a user pulls the cover 24 over the boat 26 extending it so it covers the boat 26 from bow to stern such as shown in FIG. 2. The cover 24 is pulled over the boat 26 until the fitting seams 142, 144 and 150 fit the front of the boat 26 snugly like a "glove," such as is depicted in FIG. 2. Thereafter, the user goes to the stern of the boat 26, seats the zipper teeth 136 in the zipper slide 132 and pulls the tab 130 upwardly closing the zipper 128 thereby joining the panels 25, 27 together. The user then lifts up the flap 108 to expose the cinching arrangement 98, enabling the user to grasp the ratchet 102 and tighten the cinching rope 92 causing the bottom of the cover 24 to tightly cling to the hull 28 of the boat 26.

In operation, as wind blows over, along and across the cover 24 and boat 26, the tight-fitting tailoring provided via fitting seams 142, 144 and 150, the cinching rope 92, the rear zipper arrangement 128 all work in concert to produce a relatively tightly fitting boat cover 24 that is suspended by hanger assembly 36 that stays on the boat without sliding or otherwise moving relative to the boat 26. In this same regard, the use of elastic or elastomeric straps 56 in the hanger assembly 36 in combination with the aforementioned tight fitting cover construction enables the track suspended cover 24 to withstand applied force due to wind and wave action to be able to displace the boat 26 a sufficient distance that the straps 56 can be tensioned, even elastically elongated or stretched, without exerting enough force on the cover 24 to cause relative movement between the cover 24 and boat 26. Finally, in additional to all of these features that help prevent the cover 24 tightly fitted on the boat 26 in a manner that prevents relative movement and seals out insects and debris, the upper portion of each cover panel 25, 27 is equipped with vents 174 that reduce the force of wind on the top portion of each cover panel 25, 27 when the wind is blowing by reducing the pressure differential.

It is understood that the various preferred embodiments are shown and described above to illustrate different possible features of the invention and the varying ways in which these features may be combined. Apart from combining the different features of the above one or more embodiments in varying ways, other modifications are also considered to be within the scope of the invention.

It is claimed:

1. A suspended boat cover for a suspended boat cover system for covering a boat, the suspended boat cover formed of flexible material and comprising:

an elongate track attachment region formed in the flexible material, the track attachment region extending along a top portion of the suspended boat cover and configured for attachment to an elongate track from which the suspended boat cover is suspended over a boat covered by the suspended boat cover;

a first seam formed in the flexible material is disposed below the track attachment region, the first seam extends along and adjacent a front portion of a top of the boat covered by the suspended boat cover; and a perforate wind passage region formed in the flexible material that allows wind passage completely through the suspended boat cover, the perforate wind passage region disposed between the track attachment region and the first seam extending along the first seam disposed above the front portion of the boat covered by the suspended boat cover from adjacent the first seam upwardly toward the track attachment region.

2. The suspended boat cover of claim 1 wherein the first seam formed in the flexible material extends along and adjacent a foredeck of the boat covered by the suspended boat cover, the first seam overlying the front portion of the boat.

3. The boat cover of claim 1 wherein the first seam formed in the flexible material extends at an upward angle relative to horizontal along a foredeck of the boat covered by the suspended boat cover from adjacent a front of the boat upwardly toward the track attachment region, wherein the track attachment region formed in the flexible material extends generally horizontally, and wherein the perforate wind passage region formed in the flexible material is disposed above a foredeck of the boat and extends upwardly from adjacent the first seam to adjacent the track attachment region defining a generally triangular perforate wind passage region.

4. The suspended boat cover of claim 1 wherein (a) the boat cover is comprised of a first section of the flexible material disposed above and extending downwardly along one side of the boat covered by the suspended boat cover and a second section of the flexible material disposed above and extending downwardly along the other side of the boat covered by the suspended boat cover, (b) the track attachment region extends generally horizontally and comprises an elongate generally horizontally extending reinforcing seam formed in the flexible material that joins the first and second sections of the flexible material together above the boat covered by the suspended boat cover, (c) the first seam joins the first and second sections of the flexible material together above the boat covered by the suspended boat cover and below at least a portion of the track attachment region extending above the front portion of the top of the boat covered by the suspended boat cover, and (d) the perforate wind passage region is formed in the first and second sections of the flexible material disposed above the boat covered by the suspended boat cover between the first seam and the track attachment region.

5. The suspended boat cover of claim 4 wherein the flexible material the boat cover is formed of is comprised of a single piece of fabric.

6. The suspended boat cover of claim 5 wherein the boat cover fabric is comprised of polyester or woven acrylic.

7. The suspended boat cover of claim 5 wherein the boat cover fabric is comprised of a canvas, a polyester-cotton blend or vinyl with denim backing.

8. The suspended boat cover of claim 4 further comprising a second seam formed in each one of the first and second sections of flexible material with each second seam extending along a corresponding gunwale of the boat covered by the suspended boat cover on opposite sides of the boat without joining the first and second sections together.

9. The suspended boat cover of claim 8 wherein the first seam and second seam comprise fitting seams fitting the cover to the boat.

10. The suspended boat cover of claim 8 further comprising a wind pressure differential reducing vent formed in the flexible material, the vent overlying a portion of an interior of a boat covered by the suspended boat cover and reducing a difference in pressure between outside the suspended boat cover and inside the suspended boat cover when the wind blows against the suspended boat cover, the vent (i) is disposed rearwardly of the perforate wind passage region, (ii) is disposed below the track attachment region formed in the flexible material, and (iii) is disposed above the gunwale of the boat on each side of the boat when the boat is covered by the suspended boat cover.

11. The suspended boat cover of claim 1 further comprising a cinching arrangement extending along a bottom portion of the boat cover releasably cinching the bottom portion of the boat cover against a hull of the boat.

12. The suspended boat cover of claim 11 wherein the cinching arrangement comprises a line received in a sleeve formed in the boat cover extending around the periphery of the hull of the boat and a ratchet operatively connected to the line that releasably tightens the line around the hull of the boat when releasably cinching the bottom portion of the boat cover against the hull of the boat.

13. The suspended boat cover of claim 1 wherein the boat cover is comprised of a first section of flexible material disposed above and extending downwardly along a port side of the boat covered by the suspended boat cover and a second section of flexible material extending downwardly along a starboard side of the boat covered by the boat cover, the first and second sections of flexible material joined together at one end of the boat cover fitting around a portion of a bow of the boat at one end of the boat, and the first and second sections of flexible material releasably joined together at an opposite end of the boat cover by a generally vertically extending elongate fastener fitting around a portion of a stern of the boat at an opposite end of the boat.

14. The suspended boat cover of claim 1 further comprising a stretchable suspension arrangement disposed between the track and the track attachment region formed in the flexible material that is releasably attached to the track attachment region.

15. The suspended boat cover of claim 14 wherein the stretchable suspension arrangement is comprised of a plurality of spaced apart elastic or elastomeric straps.

16. The suspended boat cover of claim 15 wherein each elastic or elastomeric strap comprises a generally vertically extending elongate bungee cord.

17. A suspended boat cover for a suspended boat cover system for covering a boat, the boat cover formed of a flexible material and comprising:

a pair of generally rectangular panels of the flexible material with one of the panels of the flexible material hanging downwardly extending along one side of a boat covered by the suspended boat cover and the other one of the panels of the flexible material hanging downwardly extending along the other side of the boat covered by the suspended boat cover;

an elongate suspended boat cover attachment region formed in the flexible material from which the boat cover is suspended, the a suspended boat cover attachment region overlying the boat covered by the suspended boat cover and joining the first and second panels of the flexible material together along a top portion of the suspended boat cover along substantially the entire length of the suspended boat cover;

an elongate seam formed in the flexible material extending along a foredeck of the boat covered by the suspended boat cover, the seam joining the first and second panels of the flexible material below the attachment region;

a perforate wind passage region formed in the joined first and second panels of the flexible material enabling passage of wind therethrough through the joined panels, the perforate wind passage region disposed above the foredeck of the boat covered by the suspended boat cover and extending from the seam upwardly to the suspended boat cover attachment region; and an arrangement extending along a bottom portion of the suspended boat cover configured for releasably securing the bottom portion of the suspended boat cover against a hull of the boat covered by the suspended boat cover.

18. The suspended boat cover of claim 17 wherein the seam joining the first and second panels of the flexible material underlies the perforate wind passage region, the seam extends upwardly at an angle relative to horizontal from adjacent a front of the boat covered by the suspended boat cover toward the suspended boat cover attachment region.

19. The suspended boat cover of claim 17 wherein each one of the first and second panels of the flexible material further comprises a second elongate seam formed in the corresponding panel of the flexible material, the second elongate seam extending generally horizontally along a gunwale of the boat covered by the suspended boat cover without joining the first and second panels.

20. The suspended boat cover of claim 17 wherein the arrangement configured for releasably securing the bottom portion around the hull of the boat covered by the suspended boat cover comprises a cinching arrangement having (a) a line received in a sleeve formed in the flexible material along a bottom of the suspended boat cover that extends around the periphery of the hull of the boat when the boat is covered by the suspended boat cover, and (b) a ratchet operatively connected to the line that releasably tightens the line around the hull of the boat covered by the suspended boat cover when releasably cinching the bottom of the boat cover against the hull of the boat.

21. The suspended boat cover of claim 17 wherein the attachment region comprises a generally horizontally extending reinforced section formed in the first and second panels of the flexible material joined by the suspended boat cover attachment region, the generally horizontally extending reinforced section (a) overlying the boat covered by the suspended boat cover, and (b) overlying the perforate wind passage region.

22. The suspended boat cover of claim 17 wherein the suspended boat cover is suspended from a stretchable suspension arrangement comprised of a plurality of spaced apart elastic or elastomeric straps each having one end attached to the attachment region formed in the first and second panels of the flexible material joined by the attachment region.

23. The suspended boat cover of claim 22 wherein each elastic or elastomeric strap comprises an elongate bungee cord.

24. A suspended boat cover in combination with a suspended boat cover system for covering a boat disposed in a slip adjacent a dock comprising:

a suspended boat cover system comprising a track carrying a stretchable boat cover suspension arrangement;

a removable suspended boat cover formed of a flexible material that is suspended by the stretchable boat cover suspension arrangement from the track, the suspended boat cover comprising (a) a pair of panels of the flexible material joined together along a top section of the suspended boat cover forming an elongate generally horizontally extending suspended boat cover attachment region extending substantially the length of the suspended boat cover that is attached to the track by the stretchable boat cover suspension arrangement, (b) an elongate seam formed in the flexible material extending along a foredeck section of a boat covered by the suspended boat cover having at least a portion extending generally upwardly from adjacent the foredeck section of the boat toward the suspended boat cover attachment region joining the panels of the flexible material together forming a joined panel section disposed above the foredeck section of the boat covered by the suspended boat cover that extends upwardly from adjacent the seam to adjacent the suspended boat cover attachment region, and (c) a plurality of perforations formed in the joined panel section forming a perforate wind passage region in the joined panel section that is disposed above the foredeck section of the boat covered by the suspended boat cover that allows wind flow therethrough.

25. The suspended boat cover and suspended boat cover system combination of claim 24 wherein the stretchable boat cover suspension arrangement comprises a plurality of downwardly hanging elastic or elastomeric straps.

26. The suspended boat cover and suspended boat cover system combination of claim 25 wherein each elastic or elastomeric strap comprises an elongate bungee cord.

27. The suspended boat cover and suspended boat cover system combination of claim 24 further comprising a cinching arrangement disposed along a bottom portion of the panels of the flexible material encircling a hull of the boat covered by the suspended boat cover.

28. The suspended boat cover and suspended boat cover system combination of claim 27 wherein the cinching arrangement comprises (a) a line carried by a sleeve formed in the flexible material extending along or adjacent the bottom portion of the boat cover that extends around the periphery of the hull of the boat when the boat is covered by the suspended boat cover, and (b) a ratchet operatively connected to the line that releasably tightens the line around the hull of the boat covered by the suspended boat cover when releasably cinching the bottom portion of the boat cover against the hull of the boat covered by the suspended boat cover.

* * * * *